US010775822B2

(12) United States Patent
Hsu

(10) Patent No.: US 10,775,822 B2
(45) Date of Patent: Sep. 15, 2020

(54) CIRCUIT FOR VOLTAGE REGULATION AND VOLTAGE REGULATING METHOD

(71) Applicant: REALTEK SEMICONDUCTOR CORPORATION, Hsinchu (TW)

(72) Inventor: Yuan-Ping Hsu, Hsinchu County (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 14 days.

(21) Appl. No.: 16/393,174

(22) Filed: Apr. 24, 2019

(65) Prior Publication Data

US 2019/0324485 A1 Oct. 24, 2019

(30) Foreign Application Priority Data

Apr. 24, 2018 (TW) ..... 107113787 A

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC ..... H02M 3/156; H02M 3/137; G05F 1/468; G05F 1/68; G05F 1/562; G05F 1/565; G05F 1/575; G05F 1/46; G05F 1/461; G05F 1/462; G05F 1/563; G05F 3/26
See application file for complete search history.

(56) References Cited

U.S. PATENT DOCUMENTS 6,246,221 B1 6/2001 Xi
6,603,292 B1 8/2003 Schouten et al.
9,575,499 B2 2/2017 Lee et al.
(Continued)

FOREIGN PATENT DOCUMENTS

CN 102566634 A 7/2012
TW 201606472 2/2016

OTHER PUBLICATIONS

Taiwan Intellectual Property Office, Office Action dated Nov. 19, 2018 in counter part TW application No. 107113787. English summary on p. 1.

(Continued)

*Primary Examiner* — Fred E Finch, III
*Assistant Examiner* — Rafael O De Leon Domenech
(74) *Attorney, Agent, or Firm* — WPAT, PC

(57) ABSTRACT

Disclosed is a circuit for voltage regulation, the circuit including: an amplifier operable to generate an amplifier output signal according to a reference voltage and a negative feedback voltage; an adaptive pre-driver operable to generate a bias current according to the amplifier output signal or according to the amplifier output signal and a current-dependent signal that varies with the variation of an output current, in which the bias current varies with the variation of the output current; a driving circuit operable to generate an output voltage and the output current according to the amplifier output signal; and a negative feedback circuit operable to generate the negative feedback voltage according to the output voltage. Since the bias current varies with the variation of the output current, the output impedance of the adaptive pre-driver varies with the variation of the output current so that the stability of the circuit is improved.

4 Claims, 6 Drawing Sheets

(56) References Cited

U.S. PATENT DOCUMENTS

| | | | | |
|---|---|---|---|---|
| 2002/0005711 | A1 | 1/2002 | Bakker et al. | |
| 2011/0068758 | A1* | 3/2011 | Chiu | G05F 1/575 323/280 |
| 2012/0038332 | A1* | 2/2012 | Lin | G05F 1/575 323/277 |
| 2012/0262137 | A1* | 10/2012 | Arigliano | G05F 1/573 323/277 |
| 2013/0113447 | A1* | 5/2013 | Kadanka | G05F 1/56 323/280 |
| 2013/0285631 | A1* | 10/2013 | Bisson | G05F 1/575 323/280 |
| 2014/0191739 | A1* | 7/2014 | Kim | G05F 1/56 323/280 |
| 2015/0346748 | A1* | 12/2015 | Pietri | G05F 1/575 323/280 |
| 2016/0173066 | A1* | 6/2016 | Yang | H03K 19/0013 327/109 |
| 2016/0349776 | A1* | 12/2016 | Conte | G05F 1/575 |
| 2017/0017250 | A1* | 1/2017 | Peluso | G05F 1/565 |
| 2017/0371365 | A1* | 12/2017 | Kossel | G05F 1/46 |

OTHER PUBLICATIONS

OA letter of the counterpart CN application (appl. No. 201810399304.8) dated Mar. 19, 2020. Summary of the OA letter: 1. Claims 1, 6-7, 9-10 are rejected as being anticipated by the cited reference 1 (CN102566634). 2. Claim 8 is rejected as being unpatentable over the cited reference 1 in view of the common knowledge of this technical filed.

* cited by examiner

210

CIRCUIT FOR VOLTAGE REGULATION AND VOLTAGE REGULATING METHOD

BACKGROUND OF THE INVENTION

1. Field of the Invention

The present invention relates to a regulator and a regulating method, especially to a circuit for voltage regulation and a voltage regulating method.

2. Description of Related Art

An electronic product usually has a power source such as a battery or a power supply. However, a high-frequency interference from the outside or interferences of other frequencies from the inside of the electronic product may cause the output voltage of the power source unstable so that the performance of an IC inside the electronic product may be affected. In order to prevent such problems, a low dropout regulator (LDO) is introduced for providing a stable output voltage.

A general LDO includes an amplifier, a transistor and a feedback circuit. The amplifier is configured to generate an amplifier output signal according to a reference voltage and a feedback voltage. The transistor is coupled between a power source terminal and an output terminal and configured to regulate the output current of the transistor according to the amplifier output signal so as to regulate the output voltage of the output terminal. The feedback circuit is configured to generate the feedback voltage according to the output voltage. Although the above-described LDO is operable to provide a stable output voltage, if the LDO is required to output a large current when necessary (i.e., if the output current of the transistor is a large current due to a heavy load), the transistor should have a high driving capability; consequently, the circuit area of the transistor is very large and the parasitic capacitance of the transistor in the aspect of the amplifier is very large as well, and thus the large parasitic capacitance causes the frequency response of the LDO unstable. This kind of LDO is found in the following literature: US patent of patent publication number US 20020005711 A1.

In order to solve the problems of the aforementioned LDO, some technique sets a pre-driver between the amplifier and the transistor so as to increase the stability of the LDO by the setting of the output impedance of the pre-driver. However, since the output impedance of the pre-driver is fixed, this technique cannot cope with a circumstance that the output current of the transistor varies dramatically; in other words, this technique can stabilize the LDO when the load is light (i.e., the output current of the transistor is very small), but cannot stabilize the LDO when the load is heavy. The above-described technique is found in the following literature: U.S. Pat. No. 6,246,221 B1.

SUMMARY OF THE INVENTION

An object of the present invention is to provide a circuit for voltage regulation and a voltage regulating method capable of preventing the problems of the prior art.

An embodiment of the circuit for voltage regulation of the present invention includes an amplifier, an adaptive pre-driver, a driving circuit and a feedback circuit. The amplifier is configured to generate an amplifier output signal according to a reference voltage and a negative feedback voltage. The adaptive pre-driver is configured to generate a bias current according to the amplifier output signal or according to the amplifier output signal and a current-dependent signal that varies with the variation of an output current, in which the bias current varies with the variation of the output current. The driving circuit is configured to generate an output voltage and the output current according to the amplifier output signal. The negative feedback circuit is configured to generate the negative feedback voltage according to the output voltage. Since the bias current varies with the variation of the output current, the output impedance of the adaptive pre-driver, which is dependent on the bias current, and the frequency response of the circuit for voltage regulation affected by the output impedance vary with the variation of the output current, and thereby the stability of the circuit for voltage regulation is improved.

The voltage regulating method of the present invention is carried out by the circuit for voltage regulation of the present invention or the equivalent thereof. An embodiment of the voltage regulating method includes the following steps: generating an amplifier output signal according to a reference voltage and a negative feedback voltage; generating an output voltage and an output current according to the amplifier output signal; generating a bias current according to the amplifier output signal or according to the amplifier output signal and a current-dependent signal that varies with the variation of the output current, in which the bias current varies with the variation of the output current; and generating the negative feedback voltage according to the output voltage. Since the bias current varies with the variation of the output current, the output impedance dependent on the bias current and the frequency response of the circuit for voltage regulation affected by the output impedance vary with the variation of the output current, and thereby the stability of the circuit for voltage regulation is improved.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

The following description is written by referring to terms acknowledged in this industrial field. If any term is defined in the following description, such term should be explained accordingly.

The present invention discloses a circuit for voltage regulation and a voltage regulating method capable of adaptively adjusting a frequency response in accordance with the variation of an output current and thereby improving the stability of voltage regulation.

Figure 1:
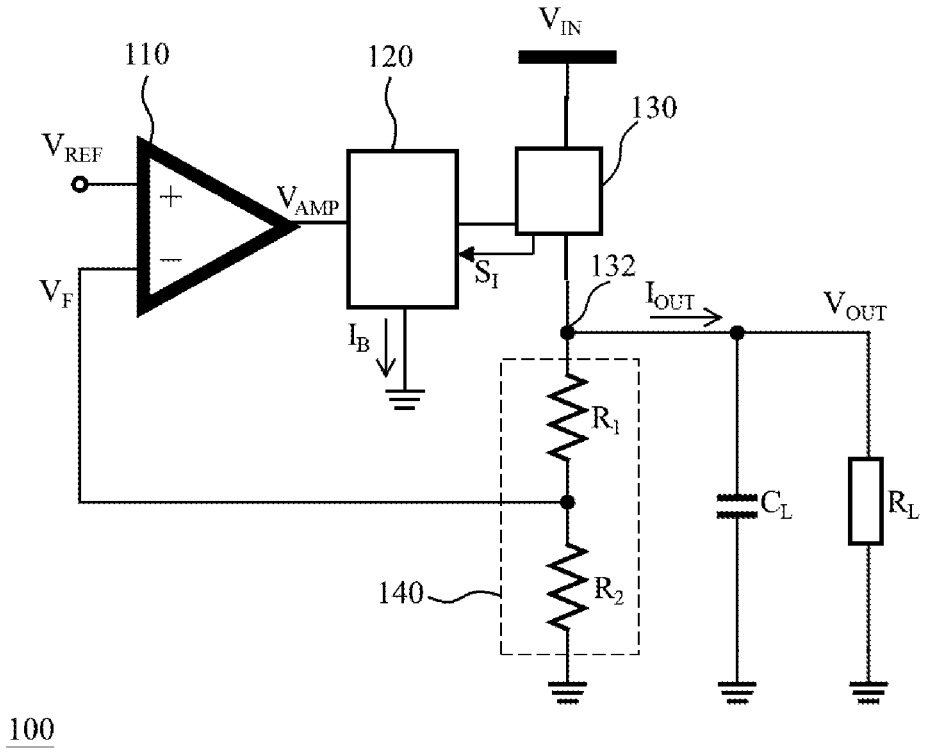
FIG. 1 shows an embodiment of the circuit for voltage regulation of the present invention.

FIG. 1 shows an embodiment of the circuit for voltage regulation of the present invention. As shown in FIG. 1, the circuit 100 for voltage regulation includes an amplifier 110, an adaptive pre-driver 120, a driving circuit 130 and a negative feedback circuit 140. The amplifier 110 is configured to generate an amplifier output signal $V_{AMP}$ according to a reference voltage $V_{REF}$ and a negative feedback voltage $V_F$. The adaptive pre-driver 120 is configured to generate a bias current $I_B$ according to a current-dependent signal $S_I$, in which the current-dependent signal $S_I$ varies with the variation of an output current $I_{OUT}$ synchronously or asynchronously and thereby the bias current $I_B$ varies with the variation of the output current $I_{OUT}$ synchronously or asynchronously; people of ordinary skill in the art can appreciate how to generate/use a signal (e.g., the amplifier output signal $V_{AMP}$ or a signal derived from the output signal $I_{OUT}$) varying with the variation of the output current $I_{OUT}$. Consequently, the output impedance of the adaptive pre-driver 120, which is dependent on the bias current $I_B$, varies with the variation of the output current $I_{OUT}$. In this embodiment, as the output current $I_{OUT}$ increases or decreases, the impedance of the adaptive pre-driver 120 changes proportionally (i.e., increases as the output current $I_{OUT}$ increases, or decreases as the output current $I_{OUT}$ decreases). The driving circuit 130 includes a transistor (e.g., PMOS transistor) or the equivalent thereof. The driving circuit 130 is coupled between a terminal of a power source voltage $V_{IN}$ and an output terminal 132 and configured to output an output voltage \$T_{OUT}$ and the output current $I_{OUT}$ through the output terminal 132; in addition, as shown in FIG. 1, the driving circuit 130 may be configured to generate the current-dependent signal $S_I$ that varies with the output current $I_{OUT}$, but the present invention is not limited thereto. The output voltage $V_{OUT}$ and the output current $I_{OUT}$ are outputted to a load $R_L$ (e.g., one or more internal circuits that are integrated into an integrated circuit, along with the circuit 100) so that the output current $I_{OUT}$ is dependent on the output voltage $V_{OUT}$ and the equivalent impedance of the load $R_L$. In addition, the output terminal 132 can be optionally coupled with a capacitor $C_L$ (e.g., an external capacitor that is set on a printed circuit board) to stabilize the output voltage $V_{OUT}$. Each of the load $R_L$ and the capacitor $C_L$ can be included in the circuit 100 or set outside the circuit 100. The negative feedback circuit 140 is coupled between the output terminal 132 and the amplifier 110 and configured to generate the negative feedback voltage $V_F$ according to the output voltage $V_{OUT}$. In this embodiment, the negative feedback circuit 140 includes two voltage-dividing resistors $R_1$, $R_2$ and the resistances of the two resistors $R_1$, $R_2$ could be the same or different. People carrying out the present invention can determine the resistances of the two resistors $R_1$, $R_2$ or use a known or self-developed negative feedback circuit to replace the negative feedback circuit 140.

Figure 2:
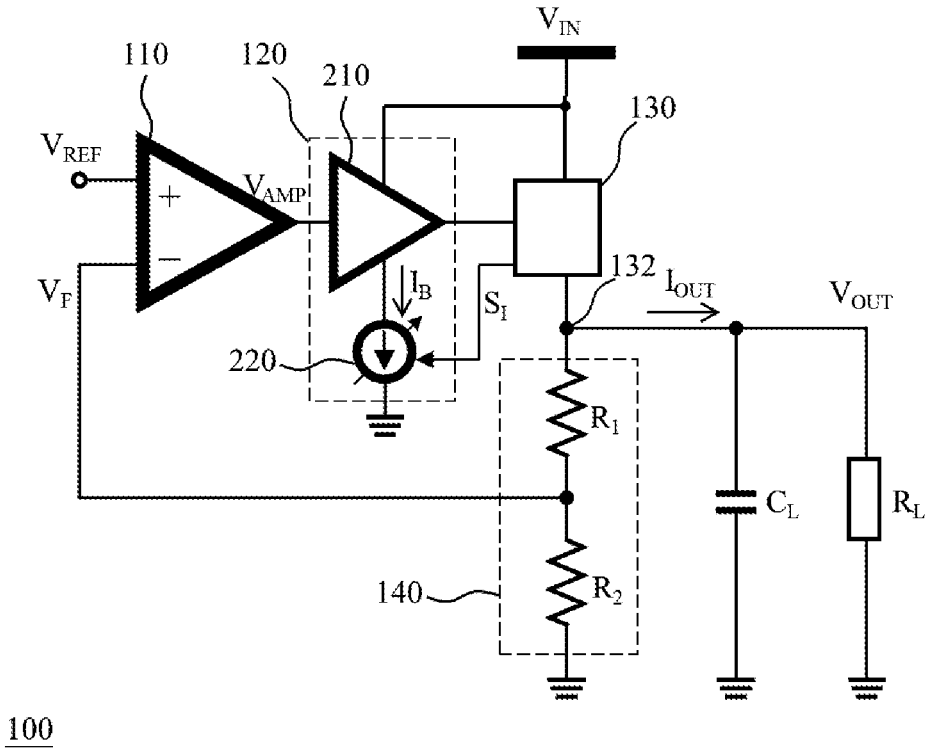
FIG. 2 shows an embodiment of the adaptive pre-driver of FIG. 1.
Figure 3A:
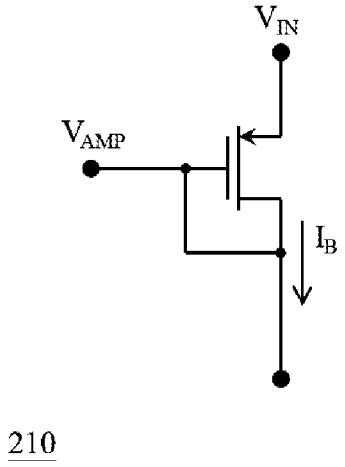
FIG. 3*a* shows an embodiment of the buffer circuit of FIG. 2.
Figure 3B:
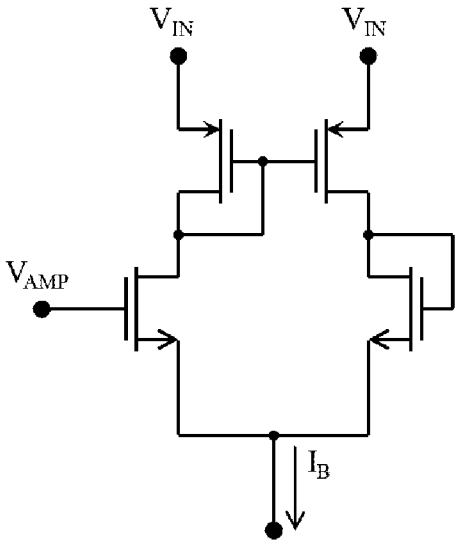
FIG. 3*b* shows an embodiment of the buffer circuit of FIG. 2.

FIG. 2 shows an embodiment of the adaptive pre-driver 120. As shown in FIG. 2, the adaptive pre-driver 120 includes a buffer circuit 210 and an adaptive current source 220. The buffer circuit 210 can be a diode-connected MOS circuit as shown in FIG. 3*a* or the equivalent of the diode-connected MOS circuit as shown in FIG. 3*b*. The buffer circuit 210 not only receives the aforementioned power source voltage $V_{IN}$ but also connects with the amplifier 110 and the driving circuit 130 so as to receive the amplifier output signal $V_{AMP}$ and output the bias current $I_B$ according to the amplifier output signal $V_{AMP}$. The adaptive current source 220 is configured to control the bias current $I_B$ according to the current-dependent signal $S_I$, in which at least a part of the bias current $I_B$ passes through the buffer circuit 210 and thus the output impedance of the buffer circuit 210 is dependent on the at least a part of the bias current $I_B$. In this embodiment, when the at least a part of the bias current $I_B$ increases or decreases, the output impedance of the buffer circuit 210 changes inversely proportionally (i.e., decreases as the at least a part of the bias current $I_B$ increases, or increases as the at least a part of the bias current $I_B$ decreases).

Figure 4:
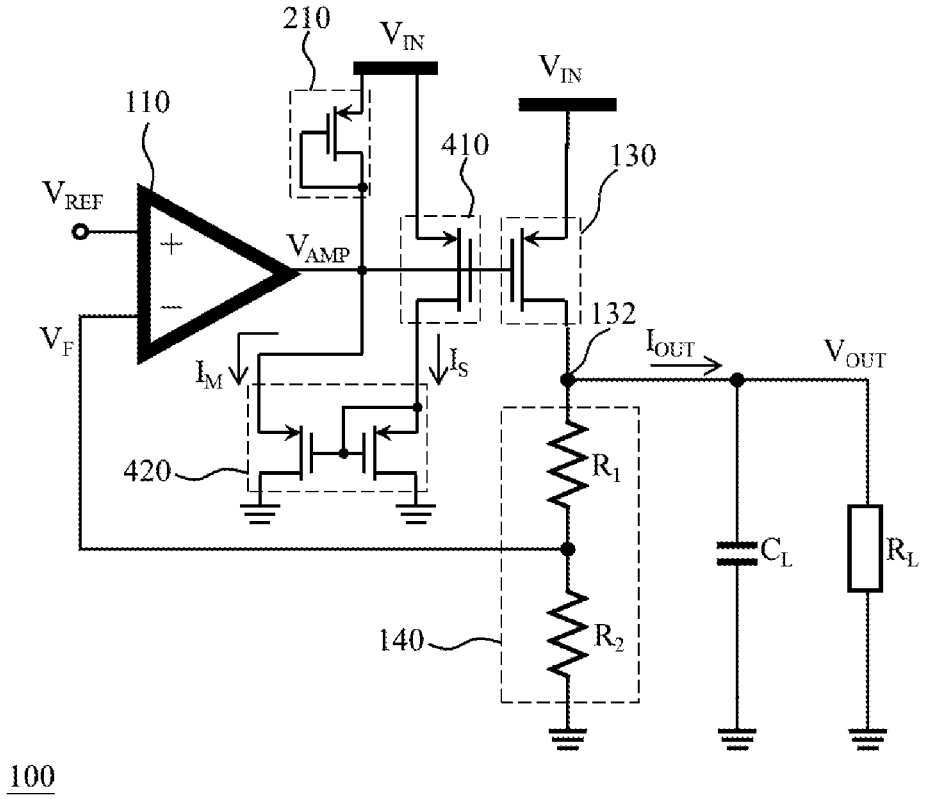
FIG. 4 shows an embodiment of the adaptive current source of FIG. 2.

FIG. 4 shows an embodiment of the adaptive current source 220. In FIG. 4 the driving circuit 130 is a PMOS transistor, the buffer circuit 210 is a diode-connected MOS circuit, the adaptive current source 220 includes a detecting circuit 410 and a current mirror 420. The detecting circuit 410 is coupled between the terminal of the power current voltage $V_{IN}$ and the current mirror 420 and configured to generate a detection current $I_S$ according to the current-dependent signal $S_I$ which is the amplifier output signal $V_{Amp}$ here. The current mirror 420 is configured to generate a mirror current $I_M$ as the bias current $I_B$ according to the detection current $I_S$. According to FIG. 4, when the amplifier output signal $V_{AMP}$ (i.e., the current-dependent signal $S_I$ here) decreases due to a heavy load, the output current $I_{OUT}$ of the driving circuit 130 and the detection current $I_S$ of the detecting circuit 410 increase; meanwhile, the mirror current $I_M$ (i.e., the bias current $I_B$) increases as the detection current $I_S$ increases; therefore, the at least a part of the bias current $I_B$, which passes through the buffer circuit 210, increases, and this leads to the decrease of the equivalent impedance of the buffer circuit 210 and has a pole contributed by the equivalent impedance of the buffer circuit 210 and the equivalent capacitance of the driving circuit 130 (including the parasitic capacitance) be moved to a position of higher frequency; accordingly, the pole does not fall within the gain bandwidth of the circuit 100 because the gain bandwidth is also moved to a position of higher frequency due to the heavy load, the phase margin increases and the stability of the circuit 100 is enhanced. Similarly, when the amplifier output signal $V_{AMP}$ (i.e., the current-dependent signal $S_I$ here) increases due to a light load, the output current $I_{OUT}$ of the driving circuit 130 and the detection current $I_S$ of the detecting circuit 410 decrease; meanwhile, the mirror current $I_M$ (i.e., the bias current $I_B$) decreases as the detection current $I_S$ decreases; therefore, the at least a part of the bias current $I_B$, which passes through the buffer circuit 210, decreases and this leads to the increase of the equivalent impedance of the buffer circuit 210 and has a pole contributed by the equivalent impedance of the buffer circuit 210 and the equivalent capacitance of the driving circuit 130 (including the parasitic capacitance) be moved to a position of lower frequency; since the gain bandwidth of the circuit 100 is also moved to a position of more lower frequency due to the light load, the pole does not fall within the gain bandwidth of the circuit 100, the phase margin is still enough and the stability of the circuit 100 is ensured.

It should be noted that although in the embodiment of FIG. 4, the current-dependent signal $S_I$ is the amplifier output signal $V_{AMP}$, this is not a limitation to the implementation of the present invention. People of ordinary skill in the art can appreciate that a signal capable of varying with the variation of the output current $I_{OUT}$ can be treated as the current-dependent signal $S_I$ on condition that the adaptive current source 220 is capable of changing the bias current $I_B$ according to the current-dependent signal $S_I$.

Figure 5:
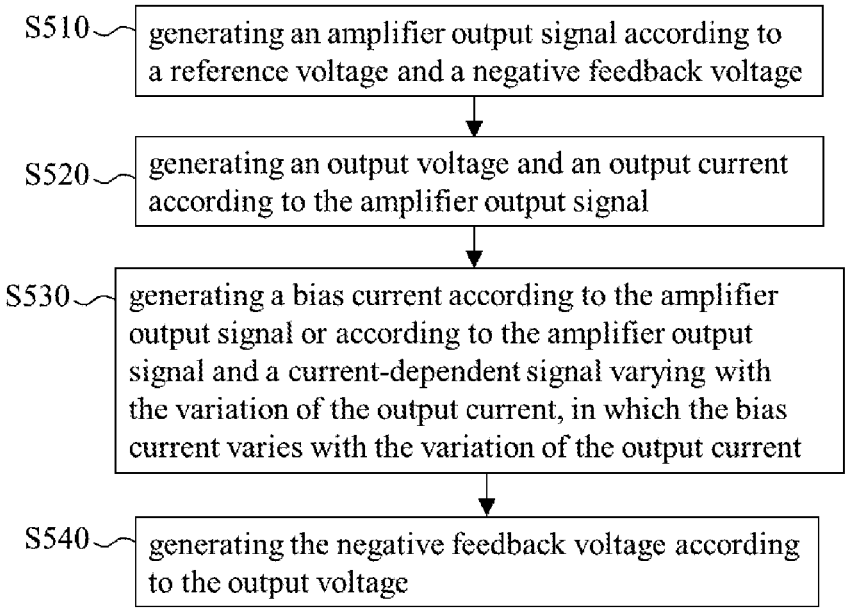
FIG. 5 shows an embodiment of the voltage regulating method of the present invention.

The voltage regulating method of the present invention is carried out by the circuit for voltage regulation of the present invention or the equivalent thereof. An embodiment of the voltage regulating method is shown in FIG. 5 and includes the following steps:

step S510: generating an amplifier output signal according to a reference voltage and a negative feedback voltage. This step can be carried out by the aforementioned amplifier 110 or the equivalent thereof.

step S520: generating an output voltage and an output current according to the amplifier output signal. This step can be carried out by the aforementioned driving circuit 130 or the equivalent thereof.

step S530: generating a bias current according to the amplifier output signal or according to the amplifier output signal and a current-dependent signal that varies with the variation of the output current, in which the bias current varies with the variation of the output current. This step can be carried out by the aforementioned adaptive pre-driver 120 or the equivalent thereof.

step S540: generating the negative feedback voltage according to the output voltage. This step can be carried out by the aforementioned negative feedback circuit 140 or the equivalent thereof.

Since those of ordinary skill in the art can appreciate the detail and the modification of the voltage regulating method of the present invention according to the disclosure of the circuit for voltage regulation of the present invention, which implies that the features of the circuit for voltage regulation can be applied to the voltage regulating method in a reasonable manner, repeated and redundant description is omitted here while the requirements of enablement and written description are still fulfilled.

It should be noted that people of ordinary skill in the art can implement the present invention by selectively using some or all of the features of any embodiment in this specification or selectively using some or all of the features of multiple embodiments in this specification as long as such implementation is practicable, which implies that the present invention can be carried out flexibly. It should also be noted that in the embodiments of this specification, "executing an operation according to a signal" or the like can be interpreted as receiving the signal to execute the operation or receiving the derivative of the signal to execute the operation, in which the derivative of the signal could be an amplified/attenuated/delayed/reversed signal of the signal and can be determined by those carrying out the present invention in accordance with their demand.

To sum up, the circuit for voltage regulation and the voltage regulating method of the present invention can adaptively adjust a frequency response according to the variation of an output current and thereby increase the stability of voltage regulation.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. A circuit for voltage regulation, comprising:

an amplifier configured to generate an amplifier output signal according to a reference voltage and a negative feedback voltage;

a driving circuit configured to generate at least an output voltage and an output current related to the amplifier output signal;

an adaptive pre-driver configured to generate a bias current according to at least the amplifier output signal, wherein the bias current varies with a variation of the output current and the adaptive pre-driver includes:

a buffer circuit including a first terminal and a second terminal, in which the first terminal is configured to receive a power source voltage and the second terminal is coupled with the amplifier and the driving circuit and configured to receive the amplifier output signal; and an adaptive current source coupled with the second terminal and configured to control the bias current according to a current-dependent signal that varies with the variation of the output current, wherein at least a part of the bias current passes through the buffer circuit and the adaptive current source includes:

a detecting circuit configured to generate a detection current according to the current-dependent signal; and a current mirror configured to generate a mirror current as the bias current according to the detection current; and a negative feedback circuit configured to generate the negative feedback voltage according to the output voltage, wherein the buffer circuit is different from the detecting circuit, and the buffer circuit is a diode-connected MOS circuit or an equivalent of the diode-connected MOS circuit.

2. The circuit of claim 1, wherein the driving circuit is further configured to generate a current-dependent signal that varies with the variation of the output current, and the adaptive pre-driver is further configured to generate the bias current according to the amplifier output signal and the current-dependent signal.

3. The voltage regulator of claim 1, wherein the current-dependent signal is the amplifier output signal.

4. The voltage regulator of claim 1, wherein the output current is dependent on the output voltage and an equivalent impedance of an internal circuit, and the output voltage is outputted to the internal circuit.

* * * * *